US009309721B2

(12) United States Patent
Petrovic et al.

(10) Patent No.: US 9,309,721 B2
(45) Date of Patent: Apr. 12, 2016

(54) ADJUSTABLE MUD MOTOR HOUSING ASSEMBLY

(71) Applicant: Mostar Directional Technologies Inc., Calgary (CA)

(72) Inventors: John Petrovic, Calgary (CA); Victor Petrovic, Calgary (CA)

(73) Assignee: Mostar Directional Technologies Inc., Calgary (CA)

( * ) Notice: Subject to any disclaimer, the term of this patent is extended or adjusted under 35 U.S.C. 154(b) by 230 days.

(21) Appl. No.: 13/795,310

(22) Filed: Mar. 12, 2013

(65) Prior Publication Data

US 2014/0262530 A1 Sep. 18, 2014

(51) Int. Cl.

| | |
|---|---|
| ***E21B 7/04*** | (2006.01) |
| ***E21B 4/02*** | (2006.01) |
| ***E21B 7/06*** | (2006.01) |

(52) U.S. Cl.
CPC .. *E21B 4/02* (2013.01); *E21B 7/067* (2013.01)

(58) Field of Classification Search
CPC ..... E21B 7/067; E21B 7/06; E21B 4/02
USPC ..... 175/61, 74, 107, 256
See application file for complete search history.

(56) References Cited

U.S. PATENT DOCUMENTS

| | | | | |
|---|---|---|---|---|
| 4,220,214 | A * | 9/1980 | Benoit | 175/61 |
| 4,303,135 | A * | 12/1981 | Benoit | 175/73 |
| 4,813,497 | A * | 3/1989 | Wenzel | 175/74 |
| 5,029,654 | A * | 7/1991 | Wilson et al. | 175/74 |
| 5,125,463 | A * | 6/1992 | Livingstone et al. | 175/74 |
| 5,248,004 | A * | 9/1993 | Witte | 175/74 |
| 5,269,385 | A * | 12/1993 | Sihlis | 175/74 |
| 5,343,966 | A * | 9/1994 | Wenzel et al. | 175/74 |
| 5,474,334 | A * | 12/1995 | Eppink | 285/184 |
| 5,479,995 | A * | 1/1996 | Falgout, Sr. | 175/74 |
| 5,495,901 | A * | 3/1996 | Livingstone et al. | 175/74 |
| 6,516,901 | B1 * | 2/2003 | Falgout, Sr. | 175/74 |
| 6,550,818 | B2 * | 4/2003 | Robin | 285/184 |
| 6,554,083 | B1 | 4/2003 | Kerstetter | |
| 6,799,646 | B1 * | 10/2004 | Daigle et al. | 175/74 |
| 7,882,904 | B2 * | 2/2011 | von Gynz-Rekowski et al. | 175/74 |
| 8,360,109 | B2 * | 1/2013 | Johnson | 138/120 |
| 2011/0140411 | A1 * | 6/2011 | Marchand | 285/184 |

* cited by examiner

*Primary Examiner* — Kenneth L Thompson
*Assistant Examiner* — Michael Wills, III
(74) *Attorney, Agent, or Firm* — Brett J. Slaney; Blake, Cassels & Graydon LLP

(57) ABSTRACT

An adjustable housing assembly is provided, which includes a splined housing and an adjusting ring which contain a splined mandrel. The splined mandrel is moveable axially within the housing assembly when disengaged from upstream and downstream portions of a drill string to disengage the mandrel from the splined housing. The splined mandrel is rotatable with the adjusting ring to alter angled interfaces between the components to change the bend angle in the housing.

20 Claims, 11 Drawing Sheets

ADJUSTABLE MUD MOTOR HOUSING ASSEMBLY

TECHNICAL FIELD

The following relates generally to mud motors for Earth drilling and more particularly to adjustable housings for such mud motors.

DESCRIPTION OF THE RELATED ART

The recovery of subterranean materials such as oil and gas typically requires drilling wellbores to a great distance beneath the earth's surface towards a repository of the material. The earthen material being drilled is often referred to as a "formation". In addition to drilling equipment situated at the surface, a drill string extends from the equipment to the material formation at the terminal end of the wellbore and includes a drill bit for drilling the wellbore.

The drill bit is rotated and drilling is accomplished by either rotating the drill string, or by use of a downhole motor near the drill bit. Drilling fluid, often termed "mud", is pumped down through the drill string at high pressures and volumes (e.g. 3000 p.s.i. at flow rates of up to 1400 gallons per minute) to emerge through nozzles or jets in the drill bit. The mud then travels back up the hole via the annulus formed between the exterior of the drill string and the wall of the wellbore. On the surface, the drilling mud may be cleaned and then re-circulated. The drilling mud serves to cool and lubricate the drill bit, to carry cuttings from the base of the bore to the surface, and to balance the hydrostatic pressure in the formation.

The downhole motor near the drill bit is commonly referred to as a "mud motor" and drives the drill bit using the mud being pumped through the drill string. In some applications, the wellbore being drilled is to follow a particular path that is not entirely vertical, thus introducing a "bend" in the wellbore. In order to have the drill string follow such a path, a housing in the vicinity of the mud motor typically includes a bend of a particular angle. Such a bend may be achieved using a fixed-bend housing, or may be set using an adjustable housing.

An example of a prior art adjustable housing 10 is shown in FIG. 1. The adjustable housing 10 shown in FIG. 1 includes a power section 12, a lock housing 14, an adjusting ring 16, and an offset housing 18. The adjusting ring 16 includes a first series of markings 20 that are to be aligned with a second series of markings 22 on the offset housing 18. The first and second series of markings 20, 22 indicate the angular bend in the housing when corresponding angles are aligned. In the example shown in FIG. 1, the zero markings on the first and second series of markings 20, 22 are aligned thus indicating "no bend". By rotating the adjusting ring 16 and offset housing 18 relative to each other, the adjustable housing 10 is adjusted to a bend angle that corresponds to the aligned markers. As the series of markings 20, 22 rotate past one another, progressively larger (or smaller if adjusting from large to small angle) bend angles are achieved as progressively larger angle markings align with each other. In order to achieve a desired setting, the adjusting ring 16 and offset housing 18 are rotated in opposite directions until the desired setting in the first series of markings 20 aligns with the desired setting in the second series of markings 22.

FIG. 2 illustrates a set of teeth 24 protruding from the offset housing 18, which mesh with complementary profiling (not shown) on the mating surface of the adjusting ring 16. The teeth 24 must be disengaged from the adjusting ring 16 in order to rotate the adjusting ring 16 relative to the offset housing 18. In order to adjust the adjustable housing 10 in FIGS. 1 and 2, the joint between the lock housing 14 and the adjusting ring 16 is broken using tongs placed on the lock housing 14 and the offset housing 18. The lock housing 14 is then backed off a number of turns while ensuring that the adjusting ring 16 and offset housing 18 remain engaged by way of the teeth 24. After backing off the lock housing 14, the adjusting ring 16 can be slid upwardly to disengage the teeth 24 from the adjusting ring 16. To adjust the bend angle, the adjusting ring 16 is rotated while keeping the teeth 24 disengaged until the required angle in the first set of markings 20 matches that angle in the second set of markings 22. The adjusting ring 16 is then slid down again to engage the teeth 24 with the adjusting ring 16 and the lock housing 14 is torqued to a recommended value. The matched value indicates the angle of bend and exact "short side" of the mud motor.

The adjustment procedure as described above can be difficult with large and heavy housings with heavy mud motors since the adjusting ring 16 needs to be both lifted and turned and the desired angle located and aligned while attempting the mesh the teeth 24 with the adjusting ring 16.

In addition to difficulties associated with the weight of the components, the lifting and turning operation can create a safety hazard from pinched fingers or hands. Moreover, the alignment of the markings 20, 22 while turning and lifting the adjusting ring 16 can be prone to misalignment thus creating errors or requiring that the process be repeated.

SUMMARY

In one aspect, there is provided an adjustable housing assembly for creating a bend between an upstream length of at least one component, and a downstream length of at least one component, the adjustable housing assembly comprising: a first annular component connectable to the downstream length at a first end, the first annular component comprising a first angled face at a second end thereof, a bore comprising a concentric portion extending to the first end and an angled portion extending to the first angled face at the second end, a first splined portion on the interior thereof, a first set of markings at the second end, and a second set of markings; a second annular component adjacent the upstream length at a first end and adjacent the first angled face at a second end, the second annular component comprising a second angled face at the first end thereof, a setting indicator on the exterior thereof at the second end, and a second splined portion on the interior thereof, the second splined portion comprising a first keyed element located at a lower end of the second angled face; and a mandrel sized to fit within the first and second annular components, the mandrel comprising a bore, a third splined portion for interfacing with the first splined portion of the first annular component, a fourth splined portion for interfacing with the second splined portion of the second annular component, and a threaded portion along a bend in the mandrel for connecting to the upstream length, the fourth splined portion including a second keyed element complementary to the first keyed element for positioning the mandrel relative to the second annular component, the second keyed element being located at an inside of the bend in the mandrel, the mandrel being movable axially within the first and second annular components when the housing assembly is untightened from the upstream and downstream lengths to disengage the first and third splined portions and permit rotation of the mandrel and the second annular component relative to the first annular component for aligning the setting indicator with a desired one of the first set of markings, the second set of markings comprising values corresponding to those on the first set of markings and being indicative of an inside of a resultant bend in the adjustable housing according to the position of the setting indicator.

In another aspect, there is provided a mandrel for an adjustable housing assembly used to create a bend between an upstream length of at least one component, and a downstream length of at least one component, the adjustable housing assembly comprising a first annular component, a second annular component, and the mandrel, the mandrel comprising: a bore; a first splined portion for interfacing with a second splined portion of the interior of the first annular component; a third splined portion for interfacing with a fourth splined portion of the interior of the second annular component; and a threaded portion along a bend in the mandrel for connecting to the upstream length, the third splined portion including a first keyed element complementary to a second keyed element in the second annular component for positioning the mandrel relative to the second annular component, the first keyed element being located at an inside of the bend in the mandrel, the mandrel being movable axially within the first and second annular components when the housing assembly is untightened from the upstream and downstream lengths to disengage the first and second splined portions and permit rotation of the mandrel and the second annular component relative to the first annular component for aligning a setting indicator on the second annular component with a desired one of a first set of markings on the first annular component.

There is also provided a first annular component for an adjustable housing assembly used to create a bend between an upstream length of at least one component, and a downstream length of at least one component, the adjustable housing assembly comprising the first annular component, a second annular component, and a mandrel, the first annular component being connectable to the downstream length at a first end and comprising: a first angled face at a second end thereof; a bore comprising a concentric portion extending to the first end and an angled portion extending to the first angled face at the second end; a first splined portion on the interior thereof; a first set of markings at the second end; and a second set of markings, wherein rotation of the mandrel and the second annular component relative to the first annular component aligns a setting indicator on the second annular component with a desired one of the first set of markings, the second set of markings comprising values corresponding to those on the first set of markings and being indicative of an inside of a resultant bend in the adjustable housing according to the position of the setting indicator.

There is also provided a second annular component for an adjustable housing assembly used to create a bend between an upstream length of at least one component, and a downstream length of at least one component, the adjustable housing assembly comprising a first annular component, the second annular component, and a mandrel, the second annular component being adjacent the upstream length at a first end and adjacent a first angled face of the first annular component at a second end, the second annular component comprising: a second angled face at the first end thereof; a setting indicator on the exterior thereof at the second end; and a second splined portion on the interior thereof, the second splined portion comprising a first keyed element located at a lower end of the second angled face, the first keyed element being complementary to a second keyed element on the mandrel to align the mandrel with the second annular component; wherein the mandrel is movable axially within the first and second annular components when the housing assembly is untightened from the upstream and downstream lengths to disengage the mandrel from the first annular component to permit rotation of the mandrel and the second annular component relative to the first annular component for aligning the setting indicator with a desired one of a first set of markings on the exterior of the first annular component.

BRIEF DESCRIPTION OF THE DRAWINGS

Embodiments will now be described by way of example only with reference to the appended drawings wherein.

DETAILED DESCRIPTION

Figure 2:
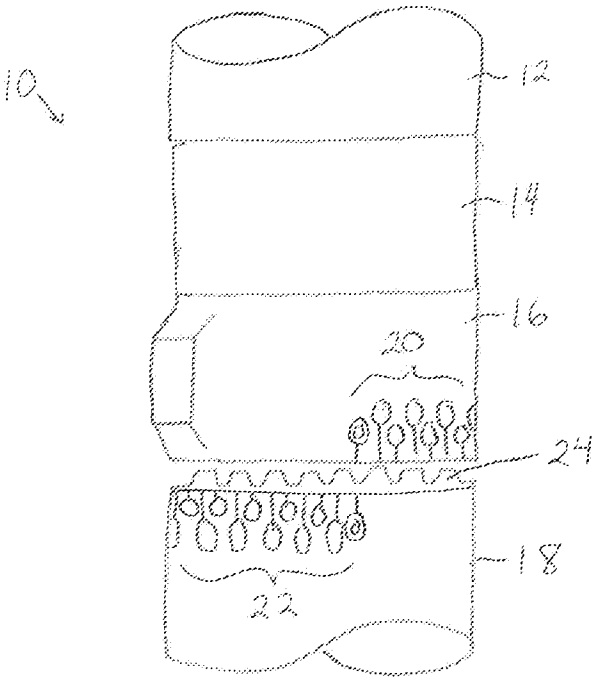
FIG. 2 PRIOR ART
FIG. 2 is a partial perspective view of a prior art adjustable mud motor housing in a disengaged position.
Figure 1:
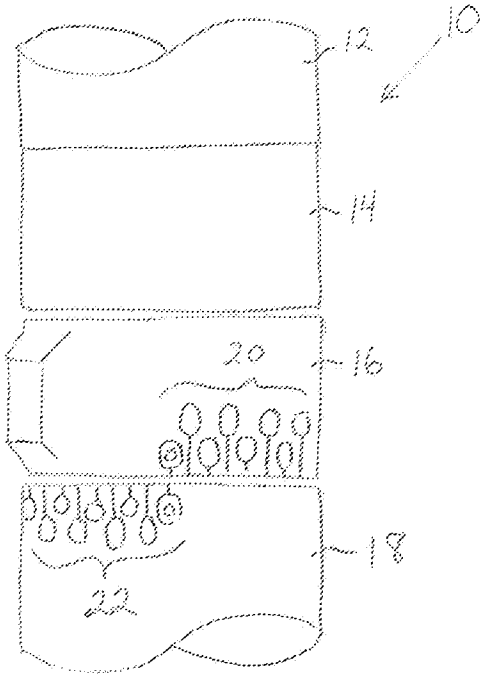
FIG. 1 PRIOR ART
FIG. 1 is a partial perspective view of a prior art adjustable mud motor housing in an engaged position.

It will be appreciated that for simplicity and clarity of illustration, where considered appropriate, reference numerals may be repeated among the figures to indicate corresponding or analogous elements. In addition, numerous specific details are set forth in order to provide a thorough understanding of the examples described herein. However, it will be understood by those of ordinary skill in the art that the examples described herein may be practiced without these specific details. In other instances, well-known methods, procedures and components have not been described in detail so as not to obscure the examples described herein. Also, the description is not to be considered as limiting the scope of the examples described herein.

It will be appreciated that the examples and corresponding diagrams used herein are for illustrative purposes only. Different configurations and terminology can be used without departing from the principles expressed herein. For instance, components and modules can be added, deleted, modified, or arranged with differing connections without departing from these principles.

The following describes an adjustable housing assembly that does not require separation of components of the housing, e.g., in order to disengage teeth, in order to allow an adjusting ring in the housing assembly to be rotated to achieve a desired angle. Instead, an internally situated splined mandrel is used that moves relative to the adjustable housing components to effectively "unlock" the adjusting ring and allow the adjusting ring to be rotated without requiring simultaneous separation of the adjusting ring relative to an adjacent section of the adjustable housing. In this way, the adjusting ring can be freely rotated when the splined mandrel is disengaged from the adjacent section.

Figure 3:
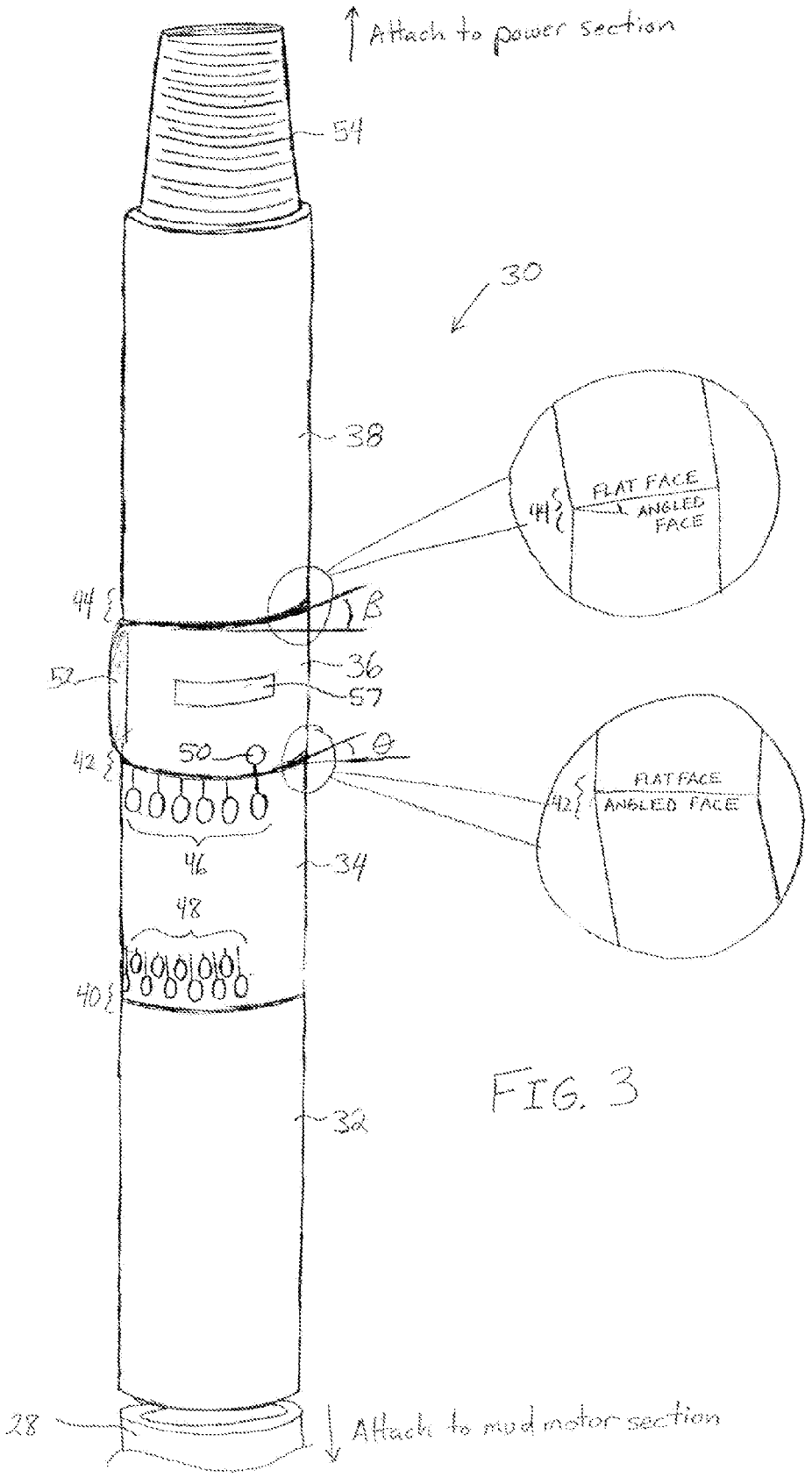
FIG. 3 is a perspective view of an adjustable mud motor housing.

Turning now to FIG. 3, an adjustable housing assembly 30 is shown. The adjustable housing assembly 30 includes a piston adapter housing 32 that connects to a downstream portion of a drill string. Typically, the adapter housing 32 connects to a mud motor bearing section 28, which is a portion of the mud motor assembly. Connected to the piston adapter housing 32 is an internally splined housing 34, which interfaces with an adjusting ring 36. The adjusting ring 36 also interfaces with an upstream portion of the drill string via a lock housing 38. As will be explained in greater detail below, the lock housing 38 is used to lock and unlock the adjustable housing assembly 30 to permit bend adjustments.

A first interface 40 between the piston adapter housing 32 and the splined housing 34 includes a threaded connection that allows the mud motor assembly to be dropped by turning back the threaded connection to achieve separation between the shoulders of the piston adapter housing 32 and the splined housing 34 (a "disengaged position"). This allows an internal connection between the splined mandrel 60 (see also FIGS. 4 and 10) and the splined housing 34 to be disengaged to allow the adjusting ring 36 to be turned relative to the splined housing 34 at a second interface 42.

When in a disengaged position, the second interface 42 between the splined housing 34 and the adjusting ring 36 permits rotation of the adjusting ring 36 relative to the splined housing 34 to allow a bend setting to be selected. As illustrated in the lower enlarged portion in FIG. 3, the second interface 42 includes an angled upper face of the splined housing 34 abutting a flat (i.e. perpendicular) lower face of the adjusting ring 36. In the example shown in FIG. 3, the angled upper face of the splined housing 34 is at an incline of $\theta°$ with respect to the flat bottom face of the splined housing 34.

A third interface 44 between the adjusting ring 36 and the lock housing 38 is maintained by a threaded connection between the internally situated splined mandrel 60 and the lock housing 38. As shown in the upper enlarged portion in FIG. 3, the third interface 44 includes an angled upper face of the adjusting ring 36 abutting a flat lower face of the lock housing 38. In this way, as the lock housing 38 is tightened against the adjusting ring 36 by turning the splined mandrel 60 into the lock housing 38, the lock housing 38 will extend from the adjusting ring 36 at an angle that is equal to the angle of the upper face of the adjusting ring 36. In the example shown in FIG. 3, the angled upper face of the adjusting ring 36 is at an incline of $\beta°$ with respect to the flat bottom face of the adjusting ring 36.

The outer surface of the splined housing 34 includes a first series of markings 46, which correspond to desired bend angles, and a second series of markings 48, which correspond to the high side of the mud motor, i.e. the inside of the "elbow" created by the bend. A third marking, hereinafter referred to as a setting indicator 50 is located on the lower portion of the splined housing 36. The setting indicator 50 aligns with one of the first series of markings 46 to create a desired bend angle by changing the nature of the second and third interfaces 44 as will be explained in greater detail below. The second series of markings 48 may be referenced to locate the high side of the mud motor, by matching a marking of the second series 48 with the selected marking of the first series 46. The adjusting ring 36 includes a protrusion or "pad" 52, which is a protective layer around a portion of the circumference of the adjusting ring 36 (see also FIG. 6 described below) that typically impacts the wall of the wellbore as the adjustable housing assembly 30 moves through the wellbore during a drilling operation to facilitate the change of direction. The pad 52 may also be used to facilitate rotation of the adjusting ring 36, when rotated by hand. The adjusting ring 36 also may include a pair of slots 57 that may be used to assist in turning the adjusting ring 36 on larger assemblies 30, e.g., using a pair of tongs or suitably sized wrench. Also shown in FIG. 3 is a threaded section 54 of the lock housing 38, which enables the adjustable housing assembly 30 to be threaded to the upstream "power" portion of the drill string.

Figure 4:
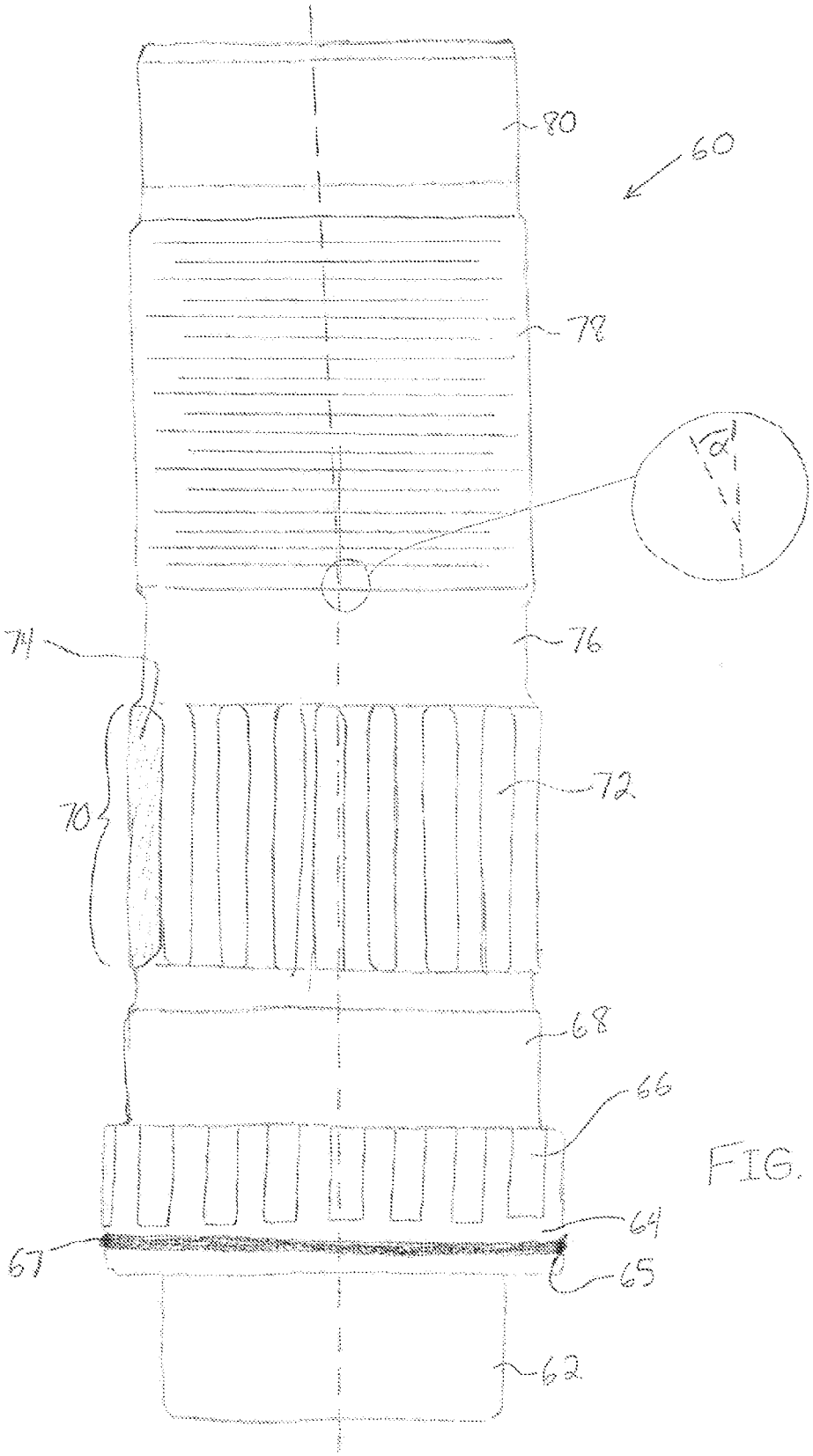
FIG. 4 is a plan view of a dual-splined mandrel used in the adjustable mud motor housing of FIG. 3.

FIG. 4 illustrates an elevation view of the splined mandrel 60, which may be machined from a single shaft of high-carbon steel and includes a bend therein at an angle of $\alpha°$. The splined mandrel 60 comprises a lower post 62 which is sized to fit within the inside diameter of the piston adapter housing 32. The post 62 extends downwardly from a splined hub 64. The shoulder created by the transition from the splined hub 64 to the post 62 engages the flat upper surface of the piston adapter housing 32 to enable the piston adapter housing 32 to bear against and support the splined hub 64 as the splined mandrel 60 moves axially within the adjustable housing assembly 30. The splined hub 64 includes a series of equally spaced keyways 66 sized to interface with a series of equally spaced, complementary keys 55 (see FIGS. 5, 10 and 11) on the interior of the splined housing 34. The splined hub 64 also includes a groove 65 for an O-ring 67 to create a seal between the splined mandrel 60 and the interior surface of the splined housing 34 for preventing the ingress of contaminants between the splined mandrel 60 and the assembly 30, and thus for ensuring a smooth rotation of the splined mandrel 60 within the housing 30. A bore in the splined mandrel 60 enables drilling fluid to pass through the adjustable housing 30.

A lower shaft 68 extends between the splined hub 64 and a splined shaft 70. The splined shaft 70 includes a series of equally spaced keys 72 and a wide key 74 interposed in the series of keys 72 at a position that corresponds to the inside of the bend of the splined mandrel 60. As will be explained in greater detail below, the wide key 74 is used to align the splined mandrel 60 within the splined housing 36 to time the splined mandrel 60, splined housing 36, and adjusting ring 34 in creating the bend angle for the housing 30. The keys 72 are sized to interface with a series of equally spaced keyways 53 (see FIG. 6) on the interior of the adjusting ring 36. The adjusting ring 36 also includes a wide keyway 51 (see FIG. 6) that is complementary to the wide key 74 of the splined mandrel 60.

An upper shaft 76 extends between the splined shaft 70 to a threaded shaft 78 and creates the bend angle in the splined mandrel 60. Consequently, the threaded shaft 78 is angled from center as illustrated in an exaggerated fashion in FIG. 4. The angle $\alpha$ permits the lock housing 38 to be torqued against the adjusting ring 36 with a bend in the adjustable housing assembly 30 without having the splined mandrel 60, which rotates with the adjusting ring 36, acting to force the adjustable housing assembly 30 to "straighten out", which can occur if the splined mandrel 60 was entirely straight. As will be discussed below (see FIG. 7), the bend in the splined mandrel 60 works in concert with an interior "bend" in the splined housing 34 to allow the threaded shaft 78 to extend from the splined housing 34 substantially perpendicular to its angled upper face. An upper post 80 extends from the threaded shaft 78 to facilitate insertion of the mandrel 60 into the internally threaded portion of the lock housing 38.

In order to enable the bend angle of the adjustable housing assembly 30 to be adjusted according to the markings 46, 48, 50 on the exterior of the assembly 30, the splined housing 34 and adjusting ring 36 also include internal features to "time" the components to: a) rotatably select the desired bend angle when the assembly is in a disengaged position, b) allow internal movement of the splined mandrel 60 while disengaged, and c) allow subsequent "locking" of the adjustable housing assembly 30 at the desired angle.

Figure 5:
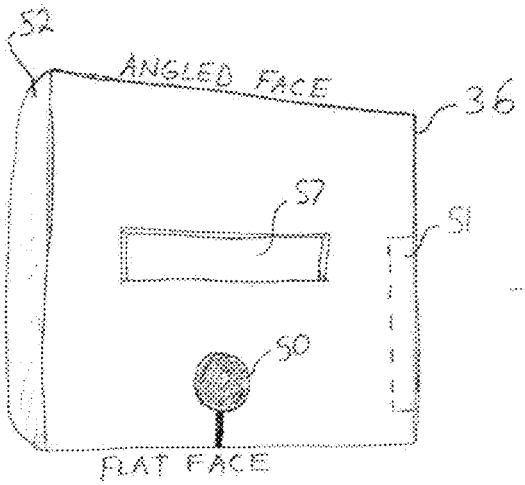
FIG. 5 is an elevation view of an adjusting ring of the adjustable mud motor housing.
Figure 6:
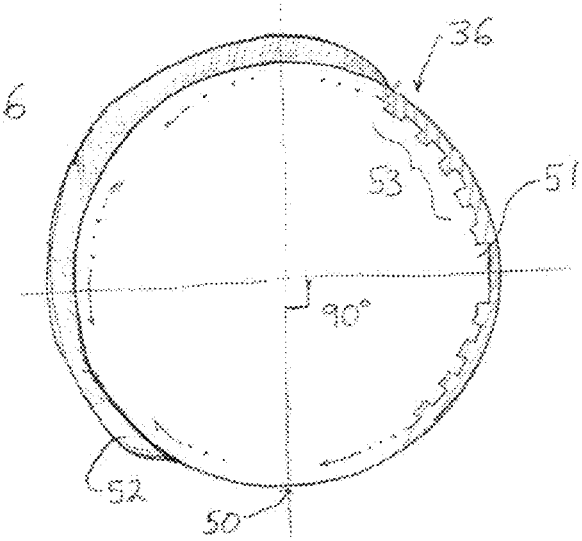
FIG. 6 is a top plan view of the adjusting ring shown in FIG. 4.

Turning now to FIG. 5, an elevation view of the adjusting ring 36 in isolation is shown. The setting indicator 50 is provided adjacent the flat lower face and positioned along the circumference of the adjusting ring 36 at approximately the mid-point along a cross-section of the incline of the angled upper face as illustrated in FIG. 5. The setting indicator 50 is also positioned relative to the wide keyway 51 interposed within the series of other similarly sized keyways 53 on the interior surface of the adjusting ring 36. As best seen in FIG. 6, the setting indicator 50 is positioned approximately 90° from the position of the wide keyway 51. This allows the second series of markings 48 to be located on the opposite side of the adjusting ring 36 with respect to the pad 52 to allow the pad to be positioned at the elbow of the bend during the range of positions. The wide keyway 51 is used to ensure a particular orientation of the splined mandrel 60 with respect to the adjusting ring 36. FIG. 6 also provides a plan view of the pad 52 illustrating an example in which the pad 52 extends around approximately half of the circumference of the adjusting ring 36 to accommodate different contact points between the pad 52 and the wellbore that result from the various bend angles permitted by the adjustable housing assembly 30.

Figure 7:
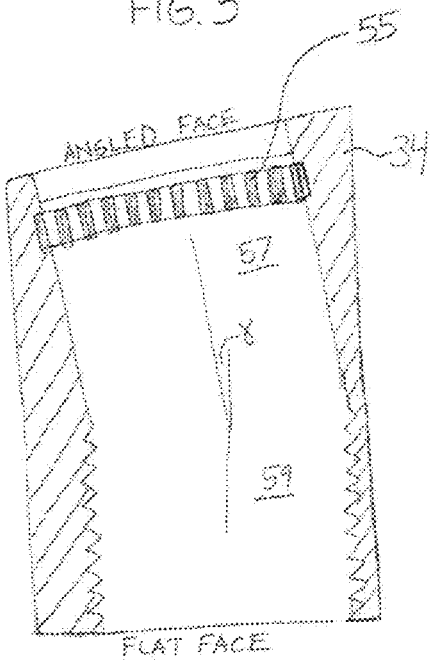
FIG. 7 is a cross-sectional view of a splined housing of the adjustable mud motor housing.

Since the splined mandrel includes a bend, the interior bore of the splined housing 34 includes a lower concentric bore 59 and an upper angled bore 57 to accommodate this bend, as shown in FIG. 7. The upper bore 57 in this example is angled with respect to the center axis of the lower bore 59 by an angle $\gamma°$. The angle $\gamma°$ is equivalent to the angle of incline $\theta$ of the angled upper face of the splined housing 34 such that the upper bore 57 is perpendicular to the angled face as shown in FIG. 7. Similarly, the lower bore 59 is concentric with the outer surface of the lower portion of the splined housing 34 such that the lower bore 59 intersects the flat lower face at a perpendicular. It can be appreciated that the view shown in FIG. 7 is exaggerated and that the thickness of the splined housing 34 may be tapered towards the adjusting ring 36 to protect the splined housing 34 from being damaged.

The angles $\theta$ and $\beta$ shown in FIG. 3 work in unison to define the bend angle for the entire housing 30. The angles $\alpha$ and $\gamma$ shown in FIGS. 4 and 7 respectively are made equal to $\theta$ to enable the splined mandrel 60 to extend perpendicularly from the angled face of the splined housing 34 as discussed above. The exact values for $\beta$ and $\theta$ can be selected to define the total bend angle, wherein $\theta+\beta=\text{bend}_{MAX}$. In order to enable a zero bend setting, $\theta$ and $\beta$ are typically selected to be equal in order to cancel each other in a particular orientation. As such, typically $\theta=\beta$. It can be appreciated that in order to achieve greater bend angles for specific jobs, one could machine a new adjusting ring 36 with a larger angle $\beta$, e.g. to add half a degree. The components of the adjustable assembly 30 should be machined to allow some play in order to accommodate a slightly larger bend angle in such a situation. In this way, an existing housing assembly 30 can be modified or retrofitted to accommodate a different bend angle and subsequently machined back such that $\theta=\beta$.

Figure 8:
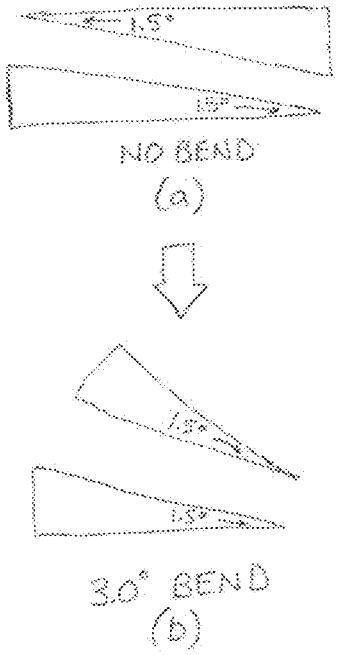
FIG. 8 is a pictorial view illustrating the effect of angled faces of drill string components when rotated relative to each other to create a bend in an adjustable mud motor housing.

FIG. 8 illustrates an example wherein $\theta=\beta=1.5°$. In view (a), FIG. 8 illustrates that by being equal, the angled faces of the splined housing 34 and adjusting ring 36 can be positioned to cancel each other out or otherwise negate the incline of each other to provide a "no bend" setting. On the other hand, the same angled faces can also be positioned at another extreme, wherein they compound each other to provide a maximum bend angle, 3° in the example shown in view (b).

Figure 9:
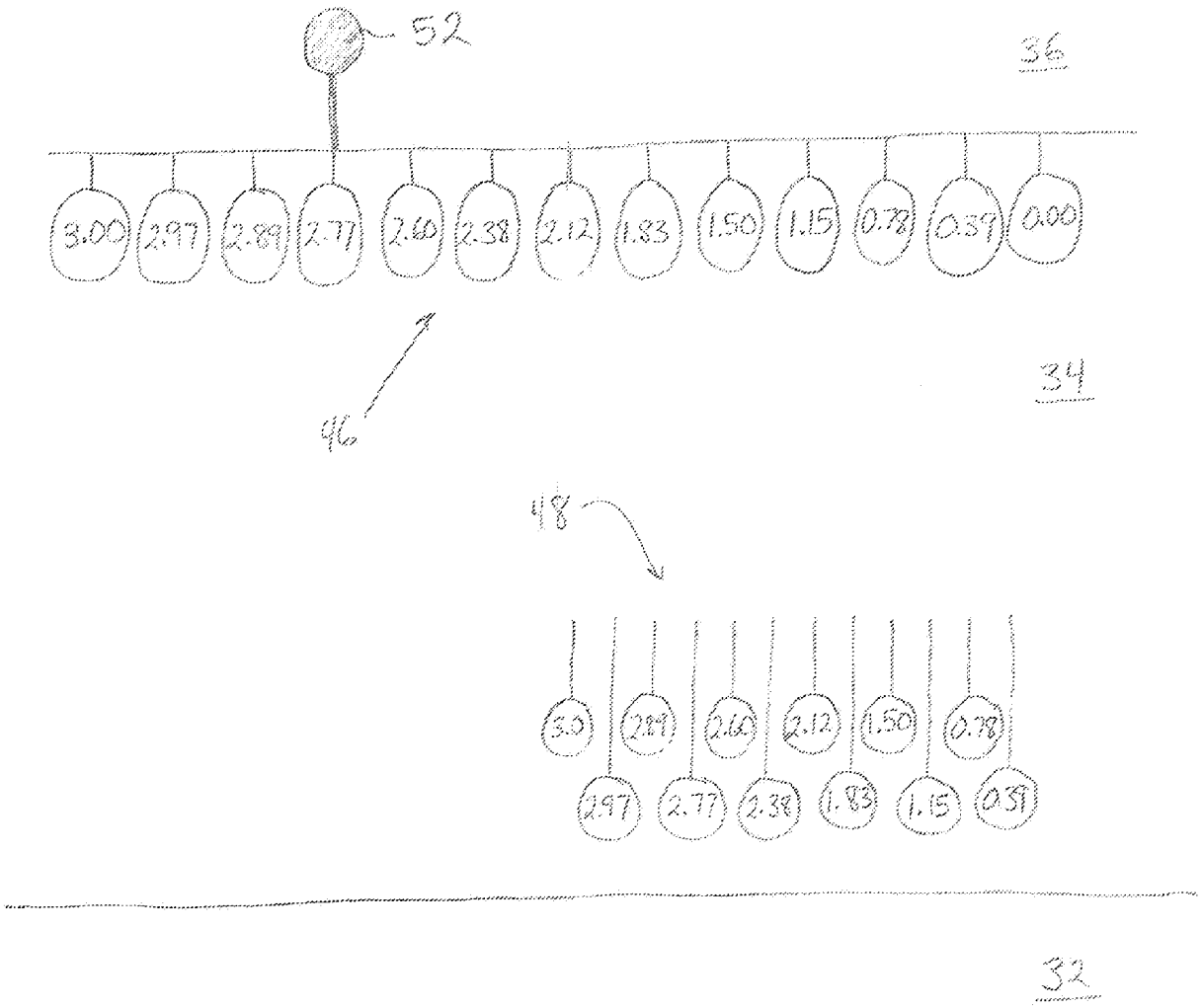
FIG. 9 is a pictorial view of alignment markings on an outer surface of an example splined housing.

A number of settings between a minimum and a maximum can be provided by spacing corresponding ones of the first series of markings 46 about the outer surface of the splined housing 34 as shown in FIG. 9. The actual angles shown in FIG. 9 are typical bend settings in the oil and gas drilling industry and these increments can be varied by changing the size of the keys 55 and keyways 66. The first series of markings 46 are spaced along 180° of the circumference of the splined housing 34 and a particular one can be aligned with the setting indicator 52 as the adjusting ring 36 is rotated relative to the splined housing 34 to obtain a desired bend angle. The second series of markings 48 is spaced twice as frequently as the first series of markings 46. As indicated above, when the setting indicator 52 is aligned with a particular one of the first series of markings 46 (e.g., 2.77 in FIG. 9), the corresponding setting in the second series of markings 48 indicates where the location of the inside of the bend. It can be appreciated that since the inside of the bend effectively moves radially according to where the setting indicator 52 is positioned, the pad 52 should have sufficient coverage to allow the pad 52 to provide impact protection throughout the range of settings.

Figure 10:
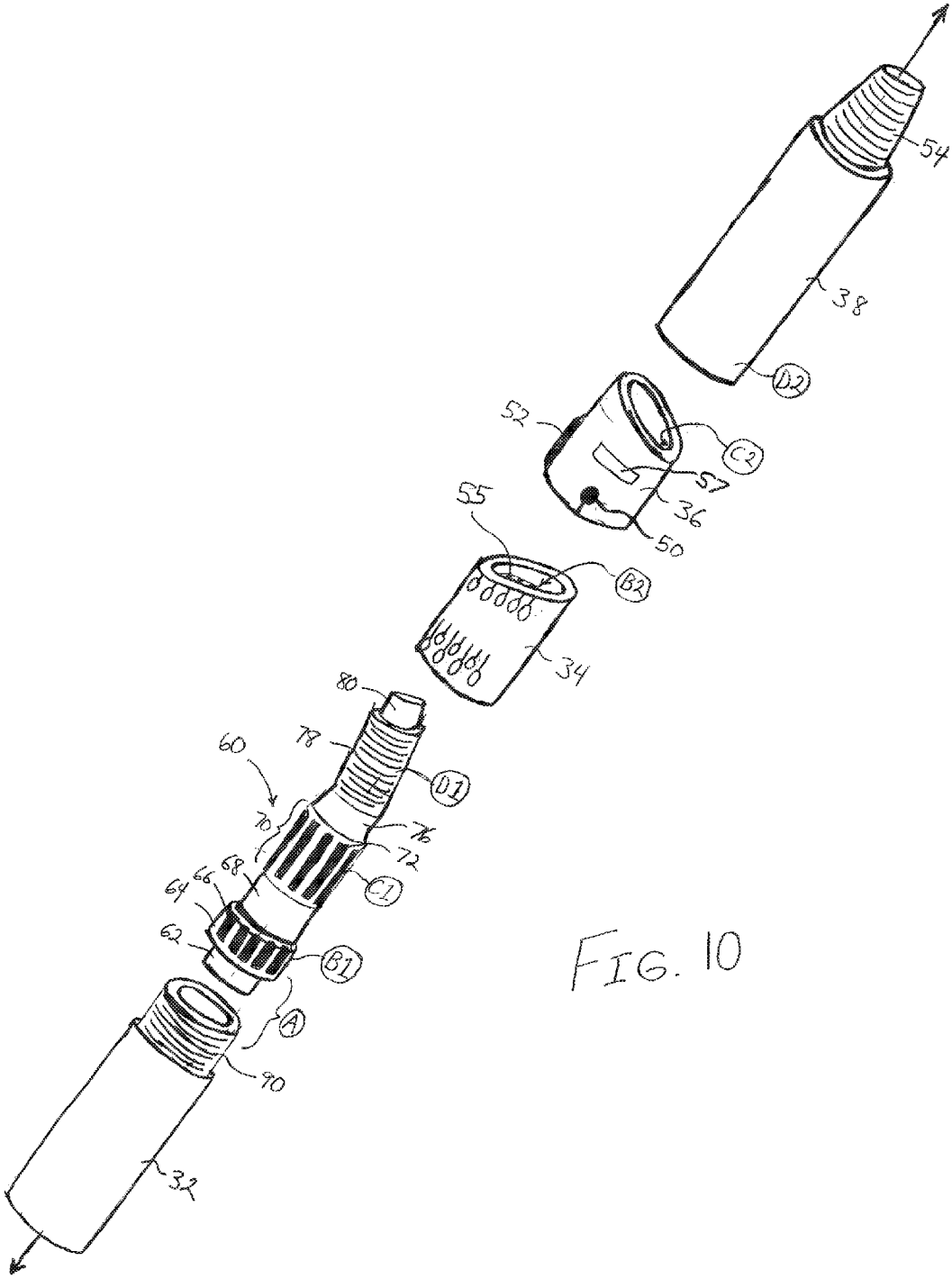
FIG. 10 is an exploded perspective view of the adjustable mud motor housing of FIG. 3.

Turning now to FIG. 10, an exploded view of the adjustable housing assembly 30 is shown. It can be appreciated that the exploded view in FIG. 10 is for illustrative purposes only and should not be considered entirely to scale. To assemble the components shown, the lower post 62 of the mandrel 60 is inserted into the interior of a threaded portion 90 of the piston adapter housing 32. The hub 64 acts as a flange or shoulder to prevent the splined mandrel 60 from sliding into the piston adapter housing 32 thus limiting how much the mandrel 60 can "drop" inside the adjustable housing assembly 30. Although not shown in FIG. 10, the interior of the threaded portion 90 of the piston adapter housing 32 may include a groove for supporting an O-ring in order to provide a seal between the lower post 62 and the threaded portion 90.

The splined housing 34 slides over the splined mandrel 60 and is threaded onto the piston adapter housing 32 when locking the housing 30 at the desired bend angle. When the splined mandrel 60 has dropped inside the adjustable housing assembly 30, the keyways 66 of the hub 64 are disengaged from the keys 55 of the splined housing 34. As will be discussed in greater detail below, when the splined mandrel 60 is raised as the threaded portion 78 threads into the lock housing 38 and the threaded portion 90 threads into the splined housing 34, the keyways 66 and keys 55 lock the splined mandrel 60 into position thus preventing further rotation of the adjusting ring 36 and splined mandrel 60 relative to the splined housing 34.

The adjusting ring 36 also slides over the splined mandrel 60 and its flat lower face abuts the angled upper face of the splined housing 34. When in abutment, the setting indicator 50 may be aligned with one of the first series of markings 46. The adjusting ring 36, in this example, is aligned with the splined mandrel 60 by aligning the wide key 74 on the splined mandrel 60 with the complementary wide keyway 51 in the adjusting ring 36. This alignment ensures that the adjusting ring 36 is timed with the splined mandrel 60, which in turn times the adjusting ring 36 with the splined housing 34. The interface between the splined shaft 70 of the splined mandrel 60 and the keyways 53 on the adjusting ring 36 is maintained throughout an adjustment procedure such that, when disengaged, any rotation of the adjusting ring 36 also rotates the splined mandrel 60 inside the adjustable housing assembly 30. In other words, the interaction between the splined mandrel 60 and the adjusting ring 36 therefore permits the splined mandrel 60 to slide axially relative to the adjusting ring 36 but not rotate with respect thereto.

The lock housing 38 is threaded onto the threaded portion 78 of the splined mandrel 60. As the lock housing 38 is tightened onto the splined mandrel 60 and the piston adapter housing 32 is tightened against the splined housing 34, the splined mandrel 60 will be forced upwardly inside the adjustable housing assembly 30 by the piston adapter housing 32, and the keyways 66 of the hub 64 will engage the keys 55 of the splined housing 34 to lock the splined mandrel 60 into a bend angle indicated by a particular one of the first series of markings 46 that is aligned with the setting indicator 50.

Figure 11:
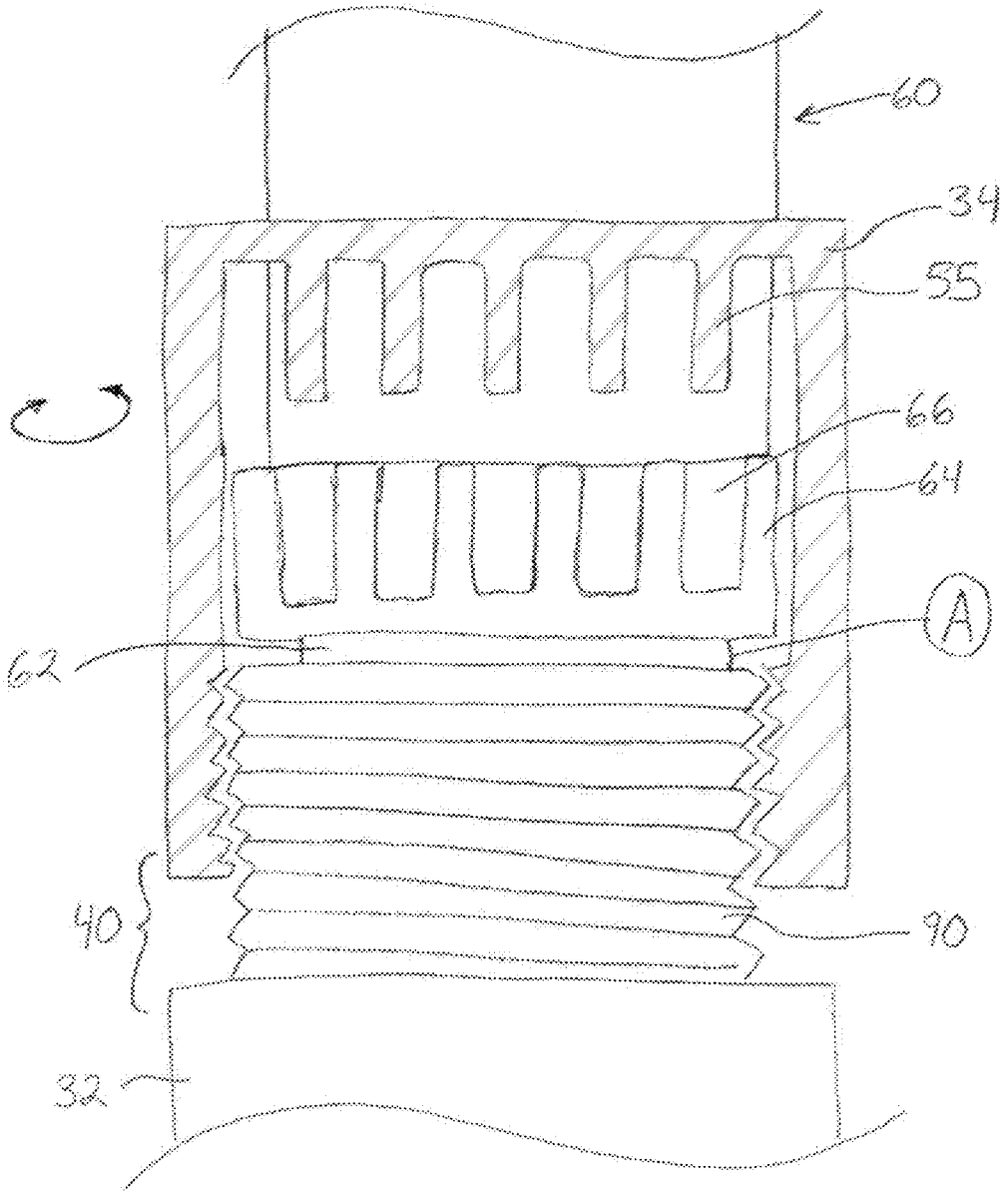
FIG. 11 is a partial sectional view of a portion of the adjustable mud motor housing of FIG. 3 in a disengaged position.
Figure 12:
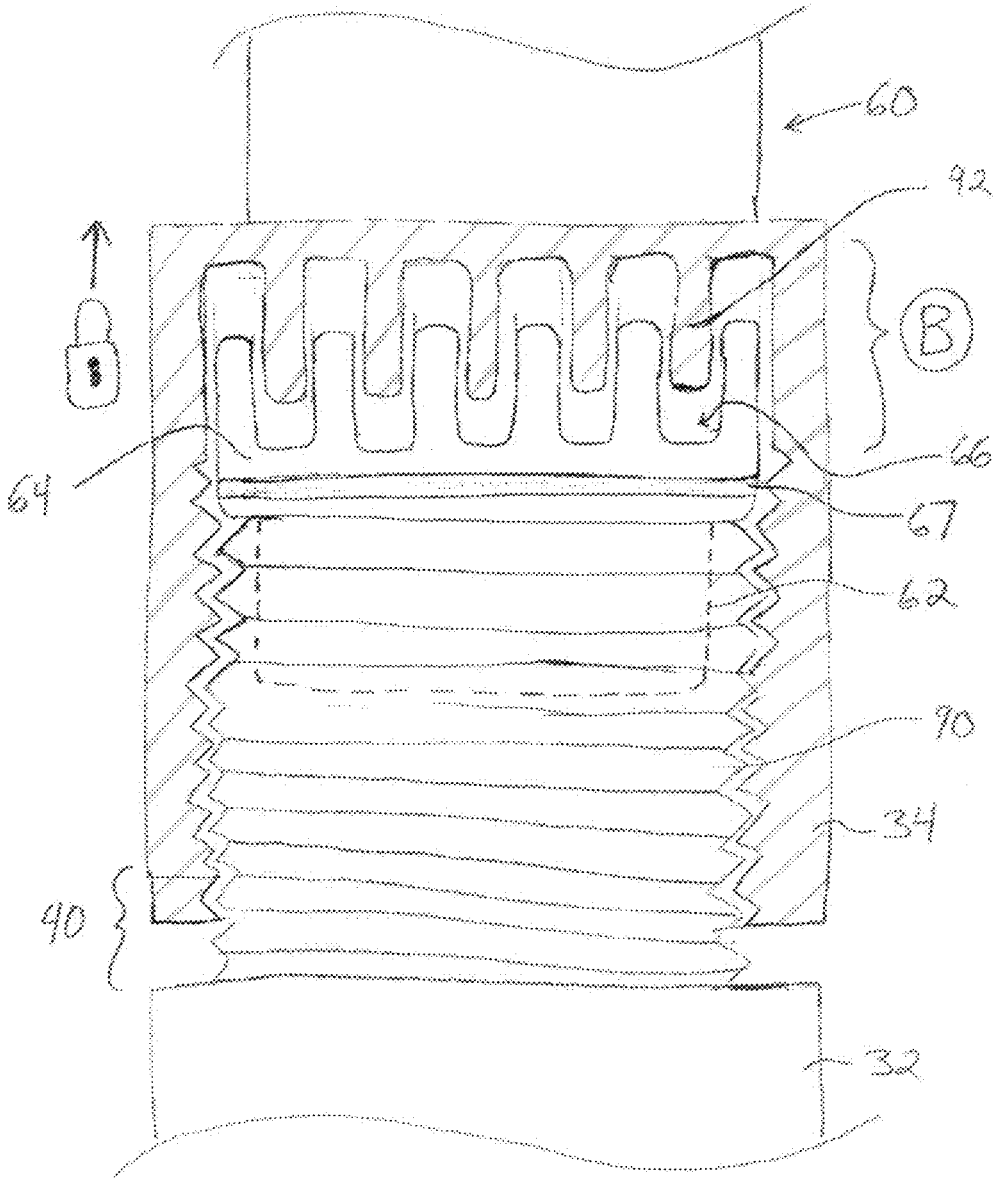
FIG. 12 is a partial sectional view of a portion of the adjustable mud motor housing of FIG. 3 during movement towards an engaged position.

FIG. 10 identifies four interactions, A, B, C, and D. Interactions A and B are shown in FIGS. 11 and 12 and illustrate how the connection between the piston adapter housing 32 and the splined housing 34 enables the splined mandrel 60 to drop inside the adjustable housing assembly 30 to disengage the keyways 66 of the hub 64 from the keys 55 of the splined housing 34. Turning first to FIG. 11 it can be seen that as the splined mandrel 60 is permitted to drop within the adjustable housing assembly 30, the interaction A between the hub 64 and the threaded portion 90 of the piston adapter housing 32 limits how low the splined mandrel 60 can drop. The splined mandrel 60 will drop when the connection between the lock housing 38 and the splined mandrel 60, and the connection between the splined housing 34 and the piston adapter housing 32, are broken. As shown in FIG. 11, as the splined mandrel 60 drops, the hub 64 becomes disengaged from the keys 55 of the splined housing 34. In this way, the splined mandrel 60 and the adjusting ring 36 can be rotated to a desired bend angle while the hub 64 is disengaged.

Turning now to FIG. 12, interaction B is illustrated, wherein the splined mandrel 60 is being raised within the adjustable housing assembly 30 to a locked or engaged position as the piston adapter housing 32 is turned into the splined housing 34. As can be seen in FIG. 12, as the splined mandrel 60 is raised by the piston adapter housing 32, the hub 34 meshes with the keys 55 of the splined housing 34 to fix the rotational position of the splined mandrel 60 within the housing assembly 20 effectively "locking" the adjustable housing assembly 30 at a particular bend angle. It can also be seen in FIG. 12 that as the splined mandrel 60 locks into the splined housing 34, the O-ring 67 will create a seal between the hub 64 and the inner surface of the splined housing 34.

Figure 13:
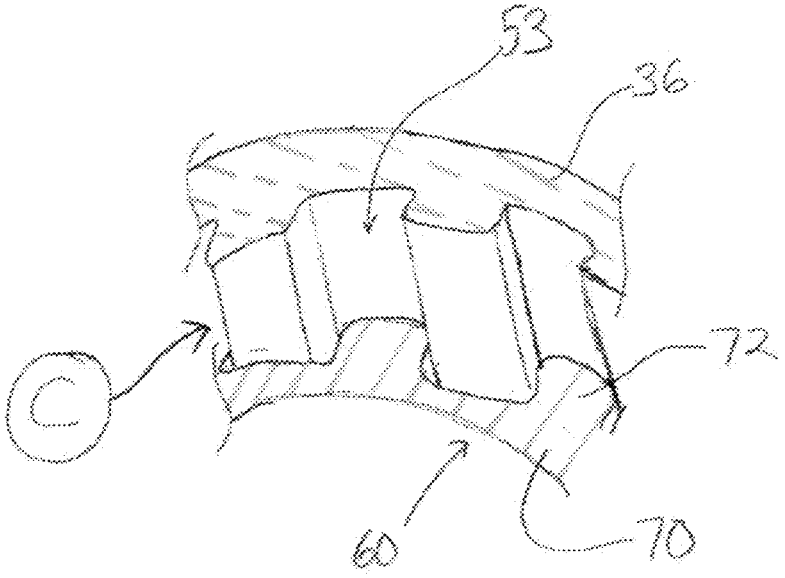
FIG. 13 is a partial perspective view of another portion of the adjustable mud motor housing of FIG. 3.

Interaction C is illustrated in FIG. 13, where the keys 72 of the splined shaft 70 are shown meshed with the keyways 53 of the adjusting ring 36. As can be appreciated from FIG. 13, interaction C permits the splined mandrel 60 to slide axially with respect to the adjusting ring 36 but through this connection rotates the splined mandrel 60 with the adjusting ring 36 thus preventing relative rotation thereof.

Figure 14:
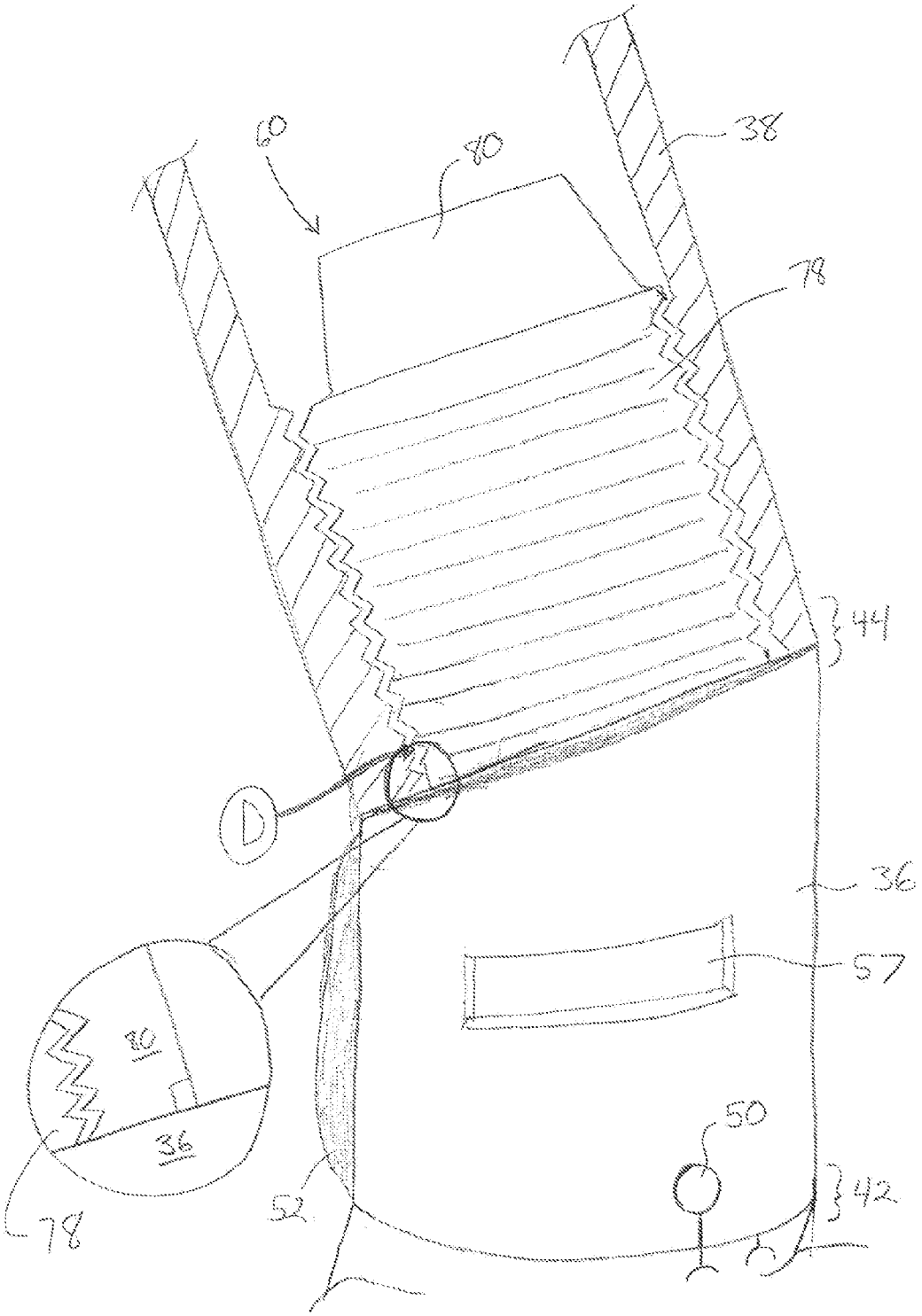
FIG. 14 is a partial sectional view of yet another portion of the adjustable mud motor housing of FIG. 3 in the engaged position.

The third interface 44 and interaction D are shown in FIG. 14. It can be appreciated that the amount of bend shown in FIG. 14 is purely for illustrative purposes and should not be considered entirely to scale. FIG. 14 illustrates that the angled upper face of the adjusting ring 36 positions the lock housing 38 at an angle relative to the adjusting ring 36. This angle will either compound an angle caused by the angled upper face of the splined housing 34, or will at least partially cancel out the angle of the upper face of the splined housing. The angled threaded portion 78 of the splined mandrel 60 permits this bend to occur without imparting a reactionary force that would otherwise act to straighten out the bend by extending through the upper surface of the adjusting ring 36 perpendicular thereto. This allows the lock housing 38 to be tightened onto the splined mandrel 60 without urging the housing 30 to straighten out.

Figures 15, 16, 17:
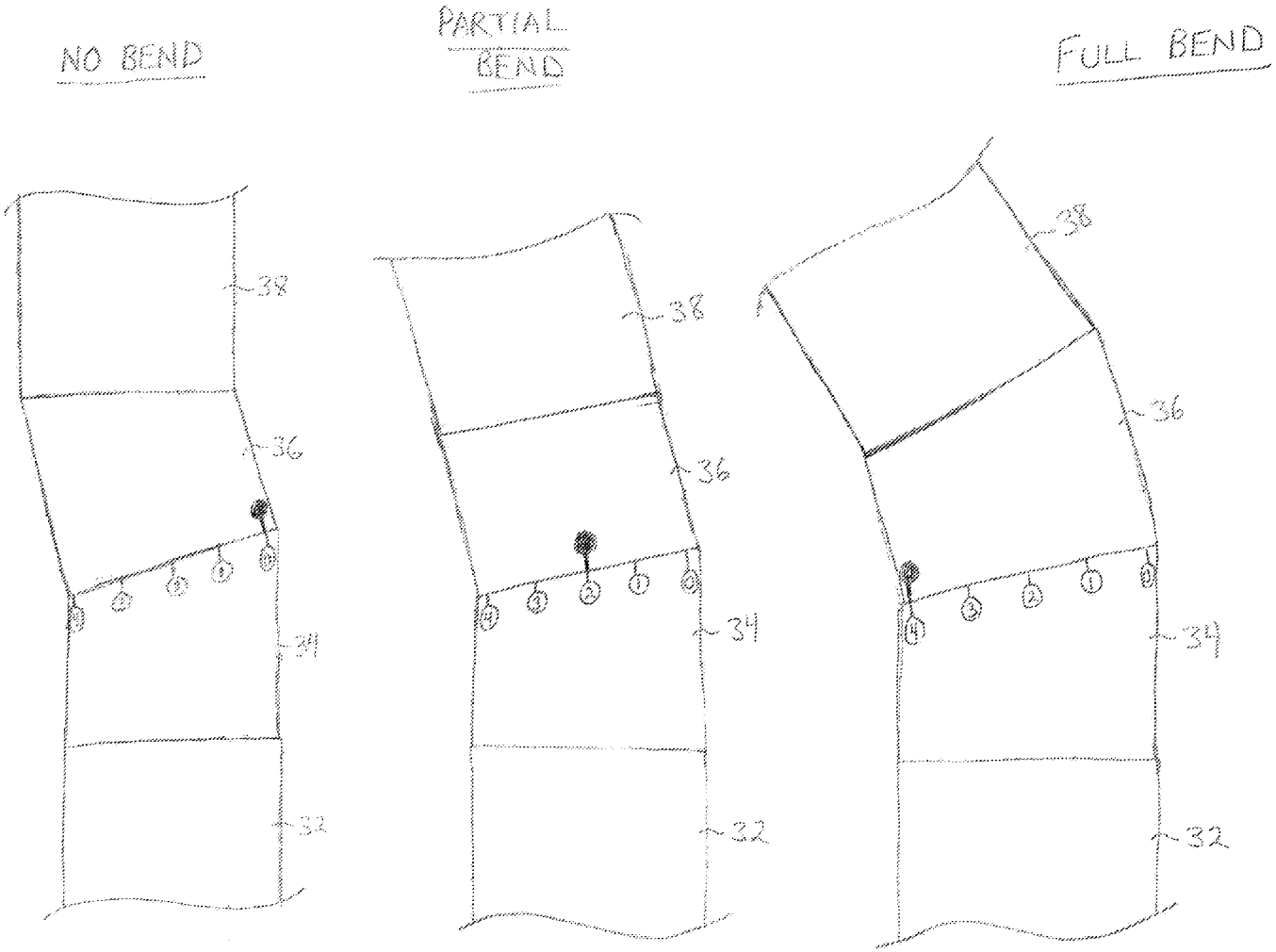
FIG. 15 is a schematic view of the adjustable mud motor housing of FIG. 3 with no bend.
FIG. 16 is a schematic view of the adjustable mud motor housing of FIG. 3 at a partial bend setting.
FIG. 17 is a schematic view of the adjustable mud motor housing of FIG. 3 at a full bend setting.

An example of an adjustment procedure is illustrated in FIGS. 15-17. It can be appreciated that the 5 bend settings shown in FIGS. 15-17 (i.e. 0, 1, 2, 3, 4) are for illustrative purposes only. FIG. 15 illustrates a "no bend" position, wherein the angled interfaces 42, 44 cancel each other out to effectively straighten the lock housing 38 relative to the piston adapter housing 32. In order to adjust the bend of the adjustable housing assembly 30, the connections are broken by placing a suitable instrument such as tongs on the lock housing 38 and the piston adapter housing 32. Once the connections have been broken, the piston adapter housing 32 is turned several times, e.g. 4 times. The adjustable housing assembly 30 is then partially disengaged, which causes the splined mandrel 60 to drop relative to the splined housing 34 and the hub 64 disengages from the keys 55. This effectively disengages the adjusting ring 36 relative to the splined housing 34 thus enabling the adjusting ring 36 to be rotated to choose a setting. As noted above, it can be appreciated that the adjusting ring 36 may have slots 57 machined into it to permit a wrench to be slotted into the adjusting ring 36.

The adjusting ring 36 is then turned to line up the setting indicator 50 with a desired one of the first series of markings 46. FIG. 16 illustrates a rotation of the adjusting ring 36 to setting "2", i.e. a partial bend. As the adjusting ring 36 is rotated, the angled interfaces 42, 44 cooperate to no longer cancel each other out and to partially compound each other to provide a bend angle that is between the no bend setting and the maximum bend setting. Once the desired setting is achieved, the motor is picked up and the piston adapter housing 32 is turned to close the gap. Tongs may then be placed above the adjusting ring 36 and below the splined housing 34 (i.e. on the piston adapter housing 32) to torque the adjustable housing assembly 30 to a predetermined specification, e.g. 43000 ft/lbs for an 8" motor. Once torqued to specification, the "2" indicated in the second series of markings 48 would indicate the high side of the motor (i.e. the inside of the bend).

This process may be repeated as necessary to create different bend angles. For example, as shown in FIG. 17, the adjusting ring 36 may be further rotated to setting "4" to achieve a maximum or full bend in this example where the angled interfaces 42, 44 completely compound each other.

It can be appreciated that the principles of the adjustable housing assembly 30 herein described may be applied to other cylindrical housings that require an adjustable bend and the thus the principles described herein should not be considered as being limited to only drilling apparatus.

Although the above principles have been described with reference to certain specific examples, various modifications thereof will be apparent to those skilled in the art as outlined in the appended claims.

The invention claimed is:

1. An adjustable housing assembly for creating a bend between an upstream length of at least one component, and a downstream length of at least one component, the adjustable housing assembly comprising:

a first annular component connectable to the downstream length at a first end, the first annular component comprising a first angled face at a second end thereof, a bore comprising a concentric portion extending to the first and an angled portion extending to the first angled face at the second end, a first splined portion on an interior thereof, a first set of markings at the second end, and a second set of markings;

a second annular component adjacent the upstream length at a first end and adjacent the first angled face at a second end, the second annular component comprising a second angled face at the first end thereof, a setting indicator on an exterior thereof at the second end, and a second splined portion on an interior thereof, the second splined portion comprising a first keyed element located at a lower end of the second angled face; and a mandrel sized to fit within the first and second annular components, the mandrel comprising a bore, a third splined portion for interfacing with the first splined portion of the first annular component, a fourth splined portion for interfacing with the second splined portion of the second annular component, and a threaded portion along a bend in the mandrel for connecting to the upstream length, the fourth splined portion including a second keyed element complementary to the first keyed element for positioning the mandrel relative to the second annular component, the second keyed element being located at an inside of the bend in the mandrel, the mandrel being movable axially within the first and second annular components when the housing assembly is untightened from the upstream and downstream lengths to disengage the first and third splined portions and permit rotation of the mandrel and the second annular component relative to the first annular component for aligning the setting indicator with a desired one of the first set of markings, the second set of markings comprising values corresponding to those on the first set of markings and being indicative of an inside of a resultant bend in the adjustable housing according to the position of the setting indicator.

2. The adjustable housing assembly of claim 1, wherein an angle of incline of the first and second angled faces are equal, the angle of incline being equal to an angle of the angled bore, and being equal to an angle of the bend in the mandrel.

3. The adjustable housing assembly of claim 1, wherein the second annular component further comprises an exterior protrusion extending around at least a portion of the circumference of the second annular component.

4. The adjustable housing assembly of claim 1, wherein the mandrel further comprises a post extending from a hub comprising the third splined portion, the post being sized to fit within a bore of a first of the downstream components.

5. The adjustable housing assembly of claim 1, wherein the setting indicator is located ninety degrees relative to the first keyed element.

6. The adjustable housing assembly of claim 1, wherein the first set of markings comprises a plurality of values spaced about an exterior of the first annular component at a first frequency, and the second set of markings comprising a plurality of corresponding values spaced about the exterior of the first annular components at a second frequency being higher than the first frequency.

7. The adjustable housing assembly of claim 6, wherein the second frequency is twice the first frequency.

8. The adjustable housing assembly of claim 7, wherein the first set of markings are spaced around one hundred and eighty degrees of the circumference of the first annular component, and the second set of markings are aligned such that corresponding zero values are substantially aligned.

9. The adjustable housing assembly of claim 1, wherein the mandrel comprises an annular groove for accommodating an O-ring to provide a seal between the mandrel and the first annular component.

10. The adjustable housing assembly of claim 1, wherein the second annular component further comprises a pair of slots in an exterior surface thereof to accommodate a tool for turning the second annular component.

11. The adjustable housing assembly of claim 1, wherein the upstream and downstream lengths comprise annular components.

12. The adjustable housing assembly of claim 11, wherein the upstream and downstream annular components are drill rods.

13. The adjustable housing assembly of claim 2, wherein the angle of incline, the angle of the angled bore, and the angle of bend in the mandrel equal 1.5'.

14. The adjustable housing assembly of claim 13, wherein the first set of markings comprises thirteen markings corresponding to values between zero and 3'.

15. The adjustable housing assembly of claim 14, wherein the values comprise 0, 0.39, 0.78, 1.15, 1.50, 1.83, 2.12, 2.38, 2.60, 2.77, 2.89, 2.97, and 3.00.

16. The adjustable housing assembly of claim 1, further comprising a first component in the downstream length for connecting the housing assembly to a mud motor section of a drilling assembly.

17. The adjustable housing assembly of claim 1, further comprising a first component in the upstream length for connecting the housing assembly to a power section of a drilling assembly.

18. A mandrel for an adjustable housing assembly used to create a bend between an upstream length of at least one component, and a downstream length of at least one component, the adjustable housing assembly comprising a first annular component, a second annular component, and the mandrel, the mandrel comprising:

a bore;

a first splined portion for interfacing with a second splined portion of an interior of the first annular component;

a third splined portion for interfacing with a fourth splined portion of an interior of the second annular component; and a threaded portion along a bend in the mandrel for connecting to the upstream length, the third splined portion including a first keyed element complementary to a second keyed element in the second annular component for positioning the mandrel relative to the second annular component, the first keyed element being aligned with an inside of the bend in the mandrel, the mandrel being movable axially within the first and second annular components when the housing assembly is untightened from the upstream and downstream lengths to disengage the first and second splined portions and permit rotation of the mandrel and the second annular component relative to the first annular component for aligning a setting indicator on the second annular component with a desired one of a first set of markings on the first annular component.

19. A first annular component for an adjustable housing assembly used to create a bend between an upstream length of at least one component, and a downstream length of at least one component, the adjustable housing assembly comprising the first annular component, a second annular component, and a mandrel, the first annular component b ing connectable to the downstream length at a first end and comprising:

a first angled face at a second end thereof;

a bore comprising a concentric portion extending to the first end and an angled portion extending to the first angled face at the second end;

a first splined portion on an interior thereof; a first set of markings at the second end; and a second set of markings, wherein rotation of the mandrel and the second annular component relative to the first annular component aligns a setting indicator on the second annular component with a desired one of the first set of markings, the second set of markings composing values corresponding to those on the first set of markings and being indicative of an inside of a resultant bend in the adjustable housing according to the position of the setting indicator.

20. A second annular component for an adjustable housing assembly used to create a bend between an upstream length of at least one component, and a downstream length of at least one component, the adjustable housing assembly comprising a first annular component, the second annular component, and a mandrel, the second annular component being adjacent the upstream length at a first end and adjacent a first angled face of the first annular component at a second end, the second annular component comprising:

a second angled face at the first end thereof;

a setting indicator on an exterior thereof at the second end; and a splined portion on an interior thereof, the splined portion comprising a first keyed element located at a lower end of the second angled face, the first keyed element being complementary to a second keyed element on the mandrel to align the mandrel with the second annular component;

wherein the mandrel is movable axially within the first and second annular components when the housing assembly is untightened from the upstream and downstream lengths to disengage the mandrel from the first annular component to permit rotation of the mandrel and the second annular component relative to the first annular component for aligning the setting indicator with a desired one of a first set of markings on the exterior of the first annular component.

* * * * *